US011920355B2

(12) United States Patent
Jansen van Vuuren et al.

(10) Patent No.: US 11,920,355 B2
(45) Date of Patent: Mar. 5, 2024

(54) BUILDING MATERIAL ATTACHMENT DEVICES, SYSTEMS, AND ASSOCIATED METHODS OF MANUFACTURE AND USE

(71) Applicant: 0776425 B.C. LTD., Abbotsford (CA)

(72) Inventors: Stefanus H Jansen van Vuuren, Abbotsford (CA); Michael D. Heppell, Abbotsford (CA); Aaron C. Fraser, Abbotsford (CA)

(73) Assignee: 0776425 B.C. LTD., Abbotsford (CA)

( * ) Notice: Subject to any disclaimer, the term of this patent is extended or adjusted under 35 U.S.C. 154(b) by 0 days.

(21) Appl. No.: 17/560,936

(22) Filed: Dec. 23, 2021

(65) Prior Publication Data

US 2023/0203820 A1 Jun. 29, 2023

(51) Int. Cl.

| | |
|---|---|
| ***E04B 9/22*** | (2006.01) |
| ***E04B 9/36*** | (2006.01) |
| ***E04F 13/08*** | (2006.01) |

(52) U.S. Cl.

CPC ..... *E04F 13/081* (2013.01); *E04B 9/225* (2013.01); *E04B 9/366* (2013.01)

(58) Field of Classification Search

CPC ..... E04D 3/36; E04D 3/3607; E04D 3/363; E04B 9/06; E04B 9/064; E04B 9/22; E04B 9/225; E04B 9/247; E04B 9/366; E04B 9/006; E04F 13/0801; E04F 13/081; E04F 13/0803; E04F 13/0812; E04F 13/0814; E04F 13/22; E04F 13/23; F16L 3/1215; F16L 3/2341

See application file for complete search history.

(56) References Cited

U.S. PATENT DOCUMENTS

| | | | | |
|---|---|---|---|---|
| 3,018,080 A * | 1/1962 | Loudon | E04B 9/006 248/228.4 |
| 3,703,794 A * | 11/1972 | Gracon | E04D 3/3601 52/506.05 |
| 4,095,385 A * | 6/1978 | Brugman | E04F 13/0814 52/762 |
| 4,400,922 A * | 8/1983 | Boyer | E04D 3/3607 52/529 |

(Continued)

FOREIGN PATENT DOCUMENTS

GB 2322881 A * 9/1998 ..... E01F 8/0017

OTHER PUBLICATIONS

RDH Building Engineering Ltd., RDH Building Sciences Inc., and Rockwool Inc., "Cladding Attachment Solutions for Exterior Insulated Commercial Walls," Graham et al., Dec. 2015, 20 pages.

(Continued)

*Primary Examiner* — Kyle J. Walraed-Sullivan
(74) *Attorney, Agent, or Firm* — Perkins Coie LLP

(57) ABSTRACT

Devices, systems, and associated methods for attaching materials (e.g., baffles, panels, etc.) to ceiling or side wall surfaces of a building and/or other substructure of a building are disclosed herein. In some embodiments, the systems include a clip having outwardly facing pockets configured to operably engage opposing protrusions of a channel of a support beam. The system can further include a locking device pivotably coupled to the clip and movable between an unlocked position and a locked position in which a portion of the locking device is positioned between the pockets to prevent the clip from inadvertently disengaging from the channel.

32 Claims, 10 Drawing Sheets

(56) References Cited

U.S. PATENT DOCUMENTS

| | | | | |
|---|---|---|---|---|
| 4,466,224 | A * | 8/1984 | Hague | E04D 3/3602 52/529 |
| 5,287,670 | A * | 2/1994 | Funaki | E04D 3/3608 52/520 |
| 5,720,460 | A * | 2/1998 | Watson | E04B 9/06 52/712 |
| 6,899,305 | B2 * | 5/2005 | Korczak | F16L 3/12 248/68.1 |
| 7,090,174 | B2 | 8/2006 | Korczak et al. | |
| 7,360,745 | B2 | 4/2008 | Nikayin et al. | |
| 8,429,866 | B2 | 4/2013 | Knight et al. | |
| D690,583 | S * | 10/2013 | Sendra-Gonzalez | F24S 25/636 D8/394 |
| 9,499,974 | B2 | 11/2016 | Bombino et al. | |
| 9,783,992 | B2 | 10/2017 | Bombino et al. | |
| 10,087,633 | B2 * | 10/2018 | Kralic | E04D 3/362 |
| D893,994 | S * | 8/2020 | Dupont-Madinier | D8/394 |
| 11,466,454 | B2 * | 10/2022 | Hedgepeth | E04B 9/18 |
| D973,478 | S * | 12/2022 | Dupont-Madinier | D8/394 |
| 2005/0093764 | A1 * | 5/2005 | Nugnes | H01Q 1/12 343/878 |
| 2007/0102613 | A1 * | 5/2007 | Wallace | E04B 9/006 248/343 |
| 2012/0137610 | A1 | 6/2012 | Knight et al. | |
| 2013/0047541 | A1 * | 2/2013 | Mayer | E04B 9/366 52/506.05 |
| 2015/0211231 | A1 * | 7/2015 | Bergman | E04B 9/04 52/489.1 |
| 2018/0127984 | A1 * | 5/2018 | Langeveld | E04B 1/40 |
| 2018/0335072 | A1 | 11/2018 | Wilson et al. | |
| 2019/0024693 | A1 | 1/2019 | Smith et al. | |
| 2020/0340246 | A1 * | 10/2020 | Bergman | E04B 9/225 |
| 2022/0275642 | A1 * | 9/2022 | Heesbeen | E04B 9/16 |

OTHER PUBLICATIONS

Rockwool Group, "Cladding Attachment Solutions For Exterior Insulated Commercial Walls," RDH Building Engineering Ltd. and RDH Building Sciences Inc., Graham et al., Dec. 2017, 16 pages.

Armatherm Z Girt Structural Thermal Break Cladding Attachment (https://www.armatherm.com/thermal-break-materials/armatherm-z-girt/), last accessed Jun. 17, 2022, 6 pages.

Eco Cladding, Cladding Systems, (https://www.ecocladding.com/systems), last accessed Jan. 18, 2022, 7 pages.

ISO Clip, Thermal Clip For Exterior Wall Assemblies (https://isoclips.com/), May 4, 2021, 12 pages.

TCLIP™ Building Envelope System (https://www.engineeredassemblies.com/en/systems/tclip%E2%84%A2-thermally-broken-facade-structure), Engineered Assemblies Inc., last accessed Jan. 18, 2022, 2 pages.

Nvelope, NH2 System Horizontal Cladding Attachment, (https://www.nvelope.com/cladding-systems-NH2-horizontal-cladding.php), last accessed Jan. 18, 2022, 4 pages.

ACS Composite Systems, Inc., Thermal Break Wall Systems, (http://acscompositesystems.com/thermal-wall-break-systems/), last accessed Jan. 18, 2022.

SMARTci Systems, SMARTci GreenGirt Clip, (https://smartcisystems.com/products/smartci-greengirt-clips/), last accessed Jan. 18, 2022, 3 pages.

International Search Report and Written Opinion received for counterpart International Application No. PCT/CA2022/051839, dated Mar. 15, 2023 (13 pages).

* cited by examiner

BUILDING MATERIAL ATTACHMENT DEVICES, SYSTEMS, AND ASSOCIATED METHODS OF MANUFACTURE AND USE

TECHNICAL FIELD

The present disclosure is generally related to devices, systems, and associated methods for attaching materials to building structures, and more particularly, to attaching baffling, paneling, cladding, and/or other materials to interior surfaces of building structures.

BACKGROUND

Effective building design requires balancing multiple objectives—aesthetics, acoustics, construction and operation costs, environmental factors, and integration of building infrastructure. Architects typically employ various material systems to meet these and other design objectives, including baffling, paneling, cladding, surface treatments, etc., each of which are applied to the ceiling and/or walls of a building structure with attachment systems.

One example of an interior surface system is a dropped ceiling, which is a secondary ceiling hung below the main structural ceiling. The dropped ceiling creates a plenum space below the main structural ceiling that can hide the routing of building infrastructure (electrical, ducting, pipework, etc.) while still providing access for repairs and inspection, and typically includes panels that improve acoustic performance. Various types of dropped ceilings are used in building design, including dropped panel, suspended baffle, dropout ceilings, etc., with each type using an attachment system to connect the dropped ceiling to the interior ceiling wall of the building structure. The attachment system for dropped ceilings generally includes a gridwork of metal channels or other attachment devices that allow the dropped ceiling to be securely and safely suspended. Acoustic baffling or cladding applied to ceilings and/or walls can also improve aesthetics and acoustic balance and control of an internal space.

DETAILED DESCRIPTION

Figure 1A:
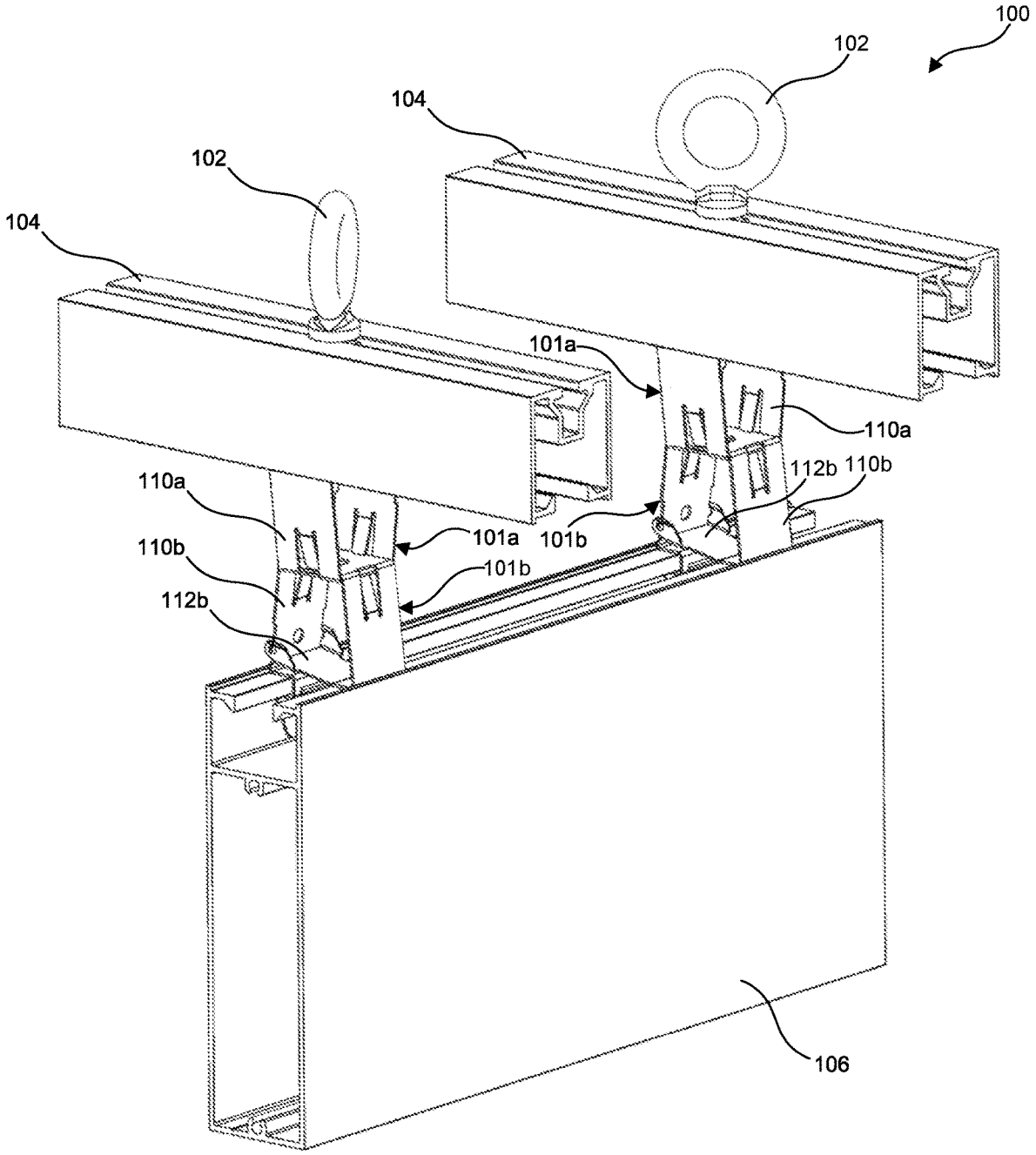
FIGS. 1A and 1B are perspective and front views, respectively, of a building material attachment system configured in accordance with some embodiments of the present technology.

The following disclosure describes various embodiments of devices and systems for attaching architectural building materials (e.g., baffling, paneling, cladding, and/or other materials and components) to an internal surface or other surface of a building structure. Unless the context clearly requires otherwise, the term "building material" is used herein for ease of reference to generally refer to any building material that may be attached to a surface of a building. By way of non-limiting examples, such building materials can have acoustic and/or aesthetic purposes and include baffles (e.g., boards, sheets, panels, ribbons, fins, beams, etc.), paneling (e.g., drop ceiling grid panels, finish panels, etc.), cladding (e.g., boards, panels, sheets, etc.), and other building materials. As described in greater detail below, various embodiments of the devices and systems described herein are modular devices that can be used in different arrangements to provide various configurations for attaching building materials onto surfaces of a building. For example, building material attachment devices configured in accordance with embodiments of the present technology can be linked together to have channel fastening features on opposite ends of the assembly for attachment between two components having channels to, e.g., suspend a baffle (see, e.g., FIGS. 1A and 1B).

Certain details are set forth in the following description and in FIGS. 1A-5 to provide a thorough understanding of various embodiments of the present technology. In other instances, well-known structures, materials, operations and/or systems often associated with building materials, building material support components and systems, building structures, etc. are not shown or described in detail in the following disclosure to avoid unnecessarily obscuring the description of the various embodiments of the technology. Those of ordinary skill in the art will recognize, however, that the present technology can be practiced without one or more of the details set forth herein, or with other structures, methods, components, and so forth.

The terminology used below is to be interpreted in its broadest reasonable manner, even though it is being used in conjunction with a detailed description of certain examples of embodiments of the present technology. Indeed, certain terms may even be emphasized below; however, any terminology intended to be interpreted in any restricted manner will be overtly and specifically defined as such in this Detailed Description section. Unless the context clearly requires otherwise, as used herein the terms "about," "generally," "substantially," and "approximately" refer to values within 10% of the stated value. In instances in which relative terminology is used in reference to something that does not include a numerical value, the terms are given their ordinary meaning to one skilled in the art.

The accompanying Figures depict embodiments of the present technology and are not intended to be limiting of its scope. The sizes of various depicted elements are not necessarily drawn to scale, and these various elements may be arbitrarily enlarged to improve legibility. Component details may be abstracted in the Figures to exclude details such as position of components and certain precise connections between such components when such details are unnecessary for a complete understanding of how to make and use the present technology. Many of the details, dimensions, angles, and other features shown in the Figures are merely illustrative of particular embodiments of the present technology. Accordingly, other embodiments can have other details, dimensions, angles, and features without departing from the present disclosure. In addition, those of ordinary skill in the art will appreciate that further embodiments of the present technology can be practiced without several of the details described below. In the Figures, identical reference numbers identify identical, or at least generally similar, elements.

Figure 1B:
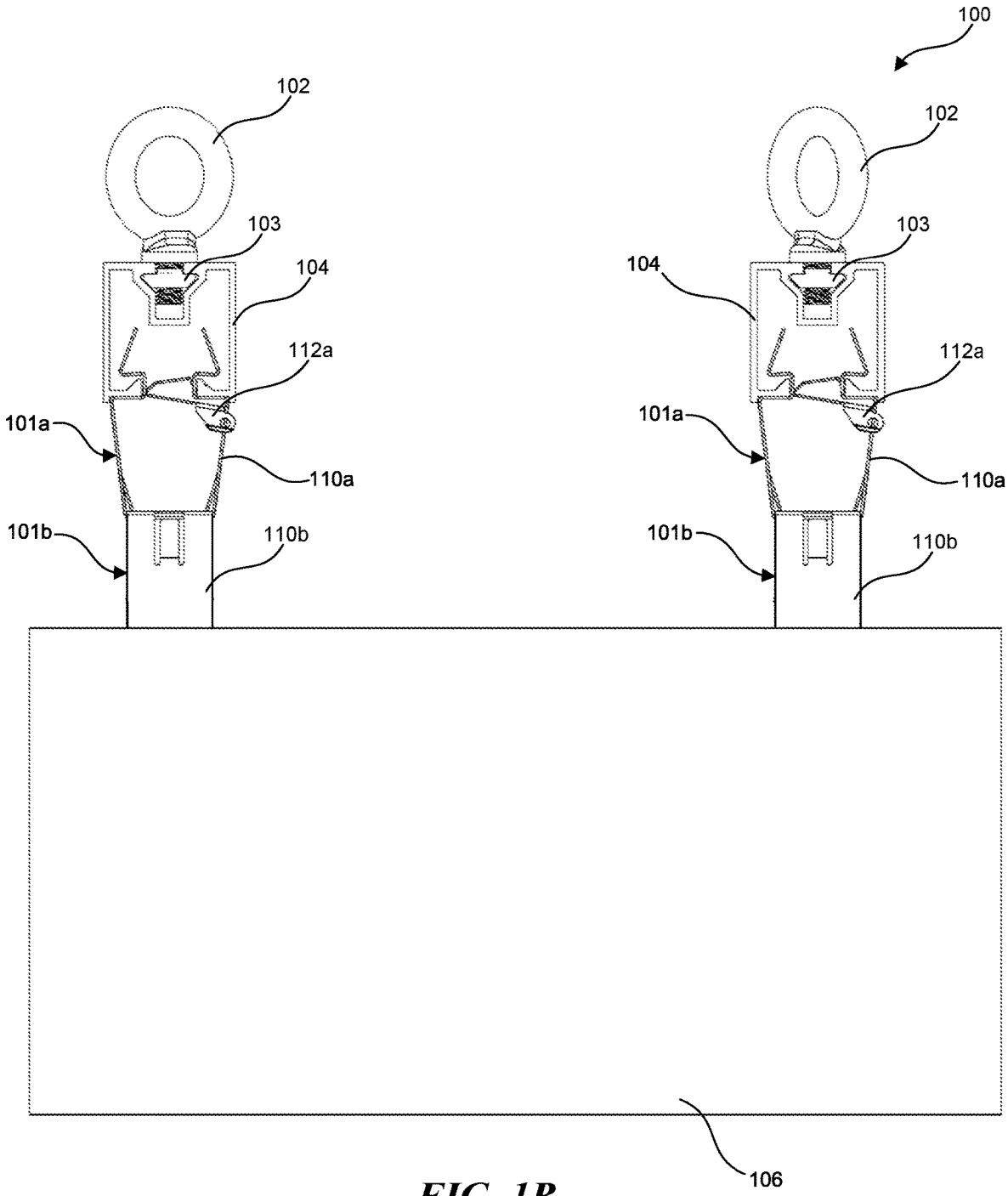

FIGS. 1A and 1B are perspective and front views, respectively, of a building material attachment system 100 ("attachment system 100" or "system 100") configured in accordance with some embodiments of the present technology. The system 100 can be attached to a ceiling wall and/or a side wall of a building ("walls"), such as a commercial building, a residential building, etc., and can include various configurations of associated components for attaching the system 100 to the walls of the building. In the illustrated embodiment, the system 100 can include any suitable components that operably engage with the walls, such as eyebolts 102 for suspending the system 100 to, e.g., a ceiling by structural cables and/or rods (not shown), or can include attachment brackets, anchors, etc. The eye bolts 102 can be coupled to corresponding support members ("support beams 104," e.g., runners) with a fastener 103 (e.g., a threaded/captured nut). The support beams 104 are configured to operably engage one or more building material attachment clips 110 ("clips 110"), illustrated in FIGS. 1A and 1B in a tandem configuration and identified individually as a first clip 110*a* coupled to the support beam 104 and a second clip 110*b* coupled to the first clip 110*a*. In the illustrated embodiment, the first and second clips 110*a* and 110*b* can be identical, or at least substantially identical, in structure and function.

The system 100 can be used to attach a building material component or member, e.g., a baffle 106, to the walls. In the illustrated embodiment, the baffle 106 can be operably engaged to the second clip 110*b* such that the baffle 106 is attached to the walls of the building by the system 100. The clips 110 can be used in combination with a locking device 112, referred to together as a clip assembly 101. The system 100 includes a first locking device 112*a* (FIG. 1B) and a second locking device 112*b* (FIG. 1A), together with the first and second clips 110*a* and 110*b*, respectively, and forming a first clip assembly 101*a* and a second clip assembly 101*b*. As described in greater detail below, the first and second locking devices 112*a* and 112*b* are configured to prevent inadvertent disengagement of the first and second clips 110*a* and 110*b* from the support beam 104 and/or the baffle 106. Although the system 100 is shown with the eyebolts 102 suitable for suspending the system with structural cables, rods, etc., in other embodiments the eyebolts 102 can be omitted and the support beams 104 can be attached to a structure of the building (e.g., a building wall, ceiling, or other surface, other support beams, a ceiling grid system, etc.) by other means.

Figure 2:
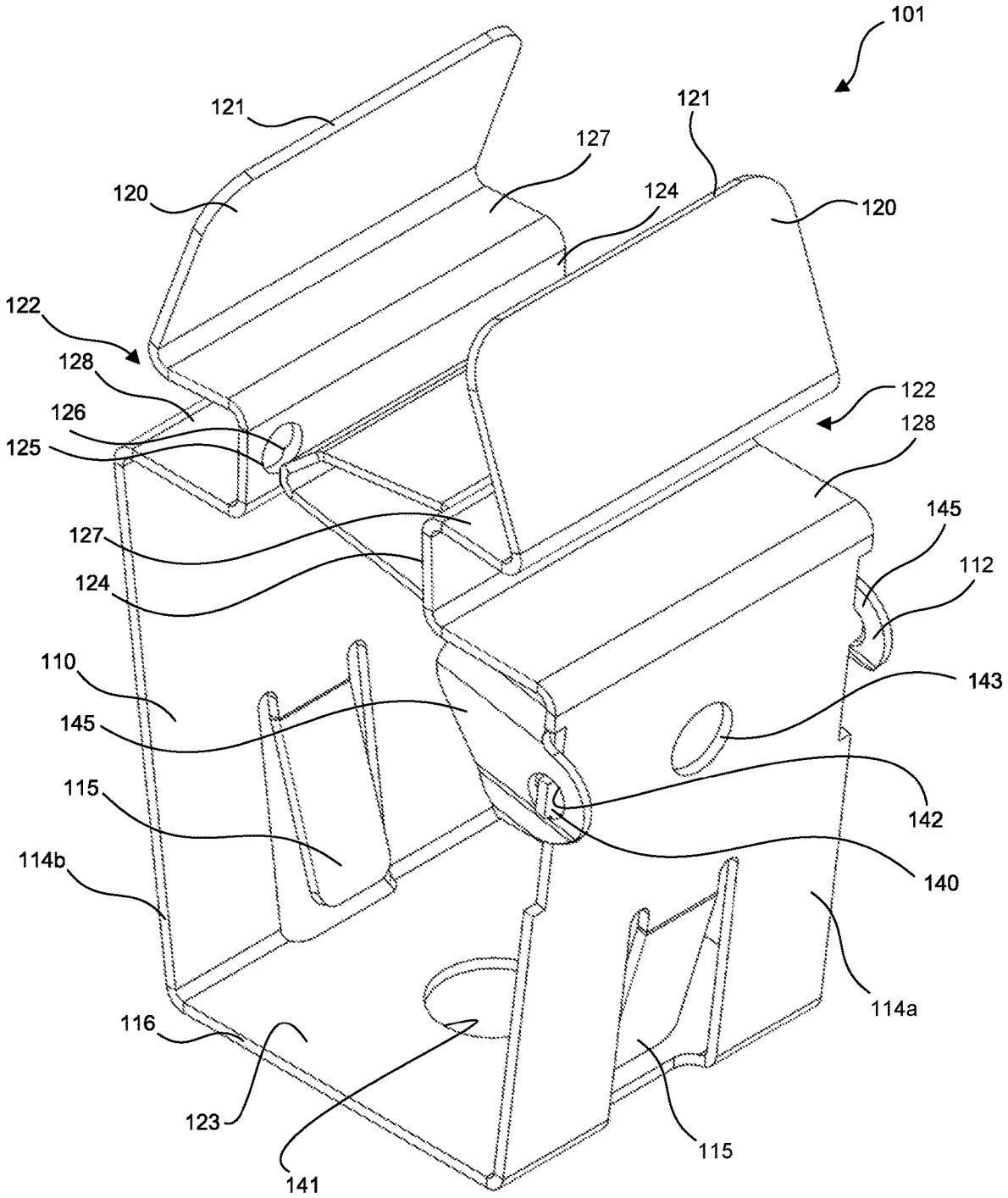
FIG. 2 is a perspective view of a building material attachment clip assembly having a building material attachment clip and a locking device configured in accordance with some embodiments of the present technology.

FIG. 2 is a perspective view of a single clip assembly 101, having the clip 110 and the locking device 112 configured in accordance with some embodiments of the present technology. The clip 110 includes a base 116 and opposing walls 114 (identified individually as a first wall 114*a* and a second wall 114*b*) projecting away from the base 116. Each of the walls 114*a* and 114*b* can include a locking tab 115 that is configured to operably engage a base 116 of a second clip 110 when two clips 110 are assembled in a tandem configuration, such as in the configurations shown in FIGS. 1A, 1B, 4A and 4B, with an inner surface 123 of the base 116 configured to abut an inner surface of a base of the second clip. Each of the walls 114*a* and 114*b* further include a recess or pocket 122 opening laterally outward from the clip 110 and configured to operably engage portions of the support beam 104, baffle 106, etc., when the clip 110 is assembled to or otherwise installed, e.g., in the system 100. The pockets 122 can be in a mirror image relationship, and each can have a first pocket wall 128, a second pocket wall 127, and an inner pocket wall 124, together defining each pocket 122.

In some embodiments, the first wall 114*a* can include a pair of pivot tabs 140 projecting outwardly from opposite edge portions thereof, and the locking device 112 can include corresponding apertures 142 in side flanges 145 thereof that are configured to receive the pivot tabs 140 to pivotally couple the locking device 112 to the clip 110. The locking device 112 can include features configured to extend between the inner pocket walls 124 when the locking device is moved into an operative position to separate and/or keep the pockets 122 spaced apart from each other, which will be described in detail below with reference to FIGS. 3A-3C. In the illustrated embodiment, the pockets 122 have "U" shapes with flat wall portions configured to receive squared off flange portions of the support beam 104 and/or the baffle 106. In other embodiments, the pockets 122 can be any suitable shape, and/or may have one or more arcuate walls, greater than three walls, etc. The inner pocket walls 124 may include one or more burst holes 125 having one or more sharp protrusions 126 configured to engage surfaces of, e.g., the support beam 104, to prevent the clip 110 from sliding longitudinally along the support beam 104 once fully installed. In the illustrated embodiment, the distal end portions of the walls 114 ("distal end portions 120") are positioned at a tapering inward angle toward each other and each terminating at a corresponding distal edge portion 121. As described in more detail below, the distal end portions 120 can facilitate installation of the clip assembly 101 to components of the system 100, e.g., the support beam 104, the baffle 106, etc.

Figure 5:
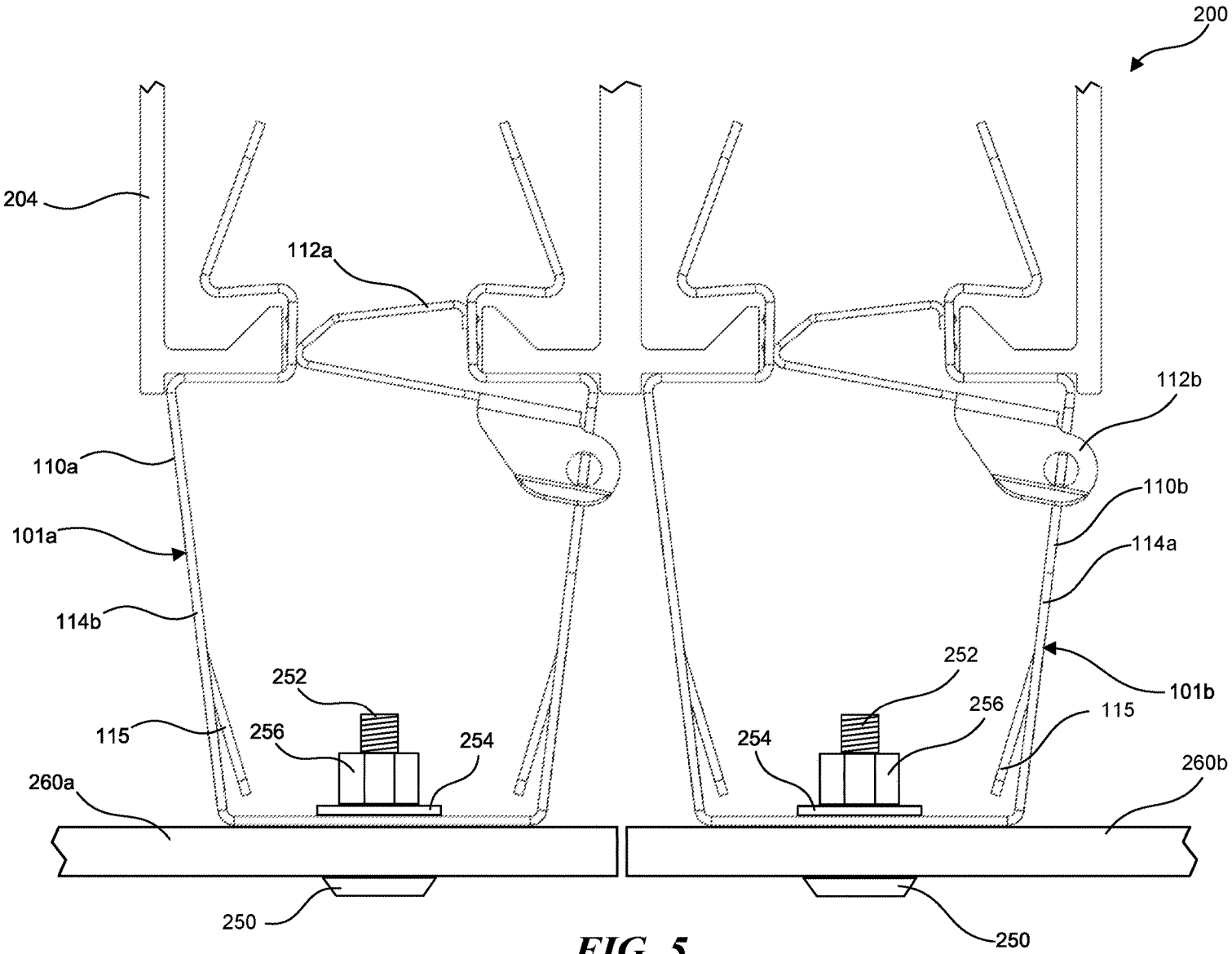
FIG. 5 is a front view illustrating a building material attachment system having an arrangement of the building material attachment clip assemblies of FIG. 2 for attaching a plurality of building material panels to a surface of a building, in accordance with some embodiments of the present technology.

In some embodiments, the base 116 can include a direct mounting aperture 141 configured to receive a fastener for mounting building materials directly to the clip 110, such as in the configuration shown in FIG. 5. The clip 110 may further include an auxiliary aperture 143 that can be used for, e.g., a seismic bracing requirement with a tie/cable/brace between auxiliary apertures 143 of adjacent but separate clips 110, for a safety requirement with a tie/cable/brace between the auxiliary aperture 143 and a beam or structure of the building, etc. The foregoing description of the apertures 141 and 143 is provided by way of example only. Accordingly, in other embodiments, the clip 110 can include other arrangements of apertures and/or other attachment features for attaching components to the clip 110. For example, in some embodiments, other aperture arrangements can be used, and/or one or more of the apertures 141 and 143 can be omitted.

The clip 110 and the locking device 112 can be formed from any suitable material, such as metal, fiberglass, carbon fiber or other composite materials, plastics, etc. In some embodiments, the clip 110 and the locking device 112 can be formed from a sheet metal, such as steel, aluminum, titanium, etc. The clip 110 and the locking device 112 can be formed by any suitable manufacturing process including, for example, stamping, extruding, machining, welding, casting, molding, etc. In some embodiments, the clip 110 and the locking device 112 are formed from sheet metal where a flat pattern is stamped or otherwise cut from the sheet metal and formed in the shape of the component using, e.g., a brake press and/or other typical sheet metal tools. In other embodiments, the clip 110 and the locking device 112 are formed by a metal extrusion process using an extrusion die, with certain of the features, e.g., the tandem locking tabs 115 the apertures 125, 141, 142, and 143, and the pivot tab 140 are formed using a secondary manufacturing operation, such as drilling, punching, waterjet cutting, plasma cutting, grinding, etc.

Figure 3A:
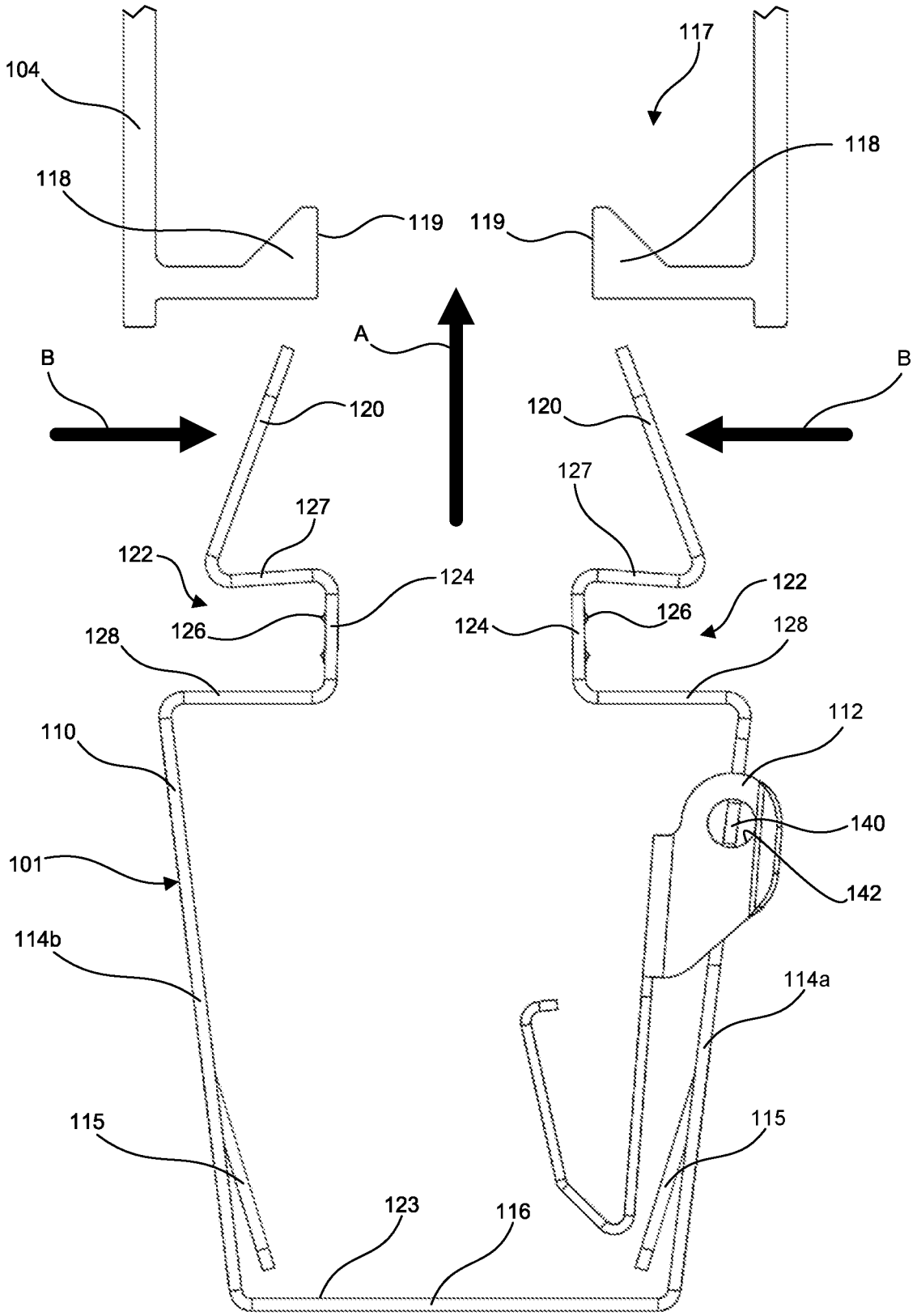
FIG. 3A is a partially exploded front view of a portion of the building material attachment system of FIGS. 1A and 1B.
Figure 3B:
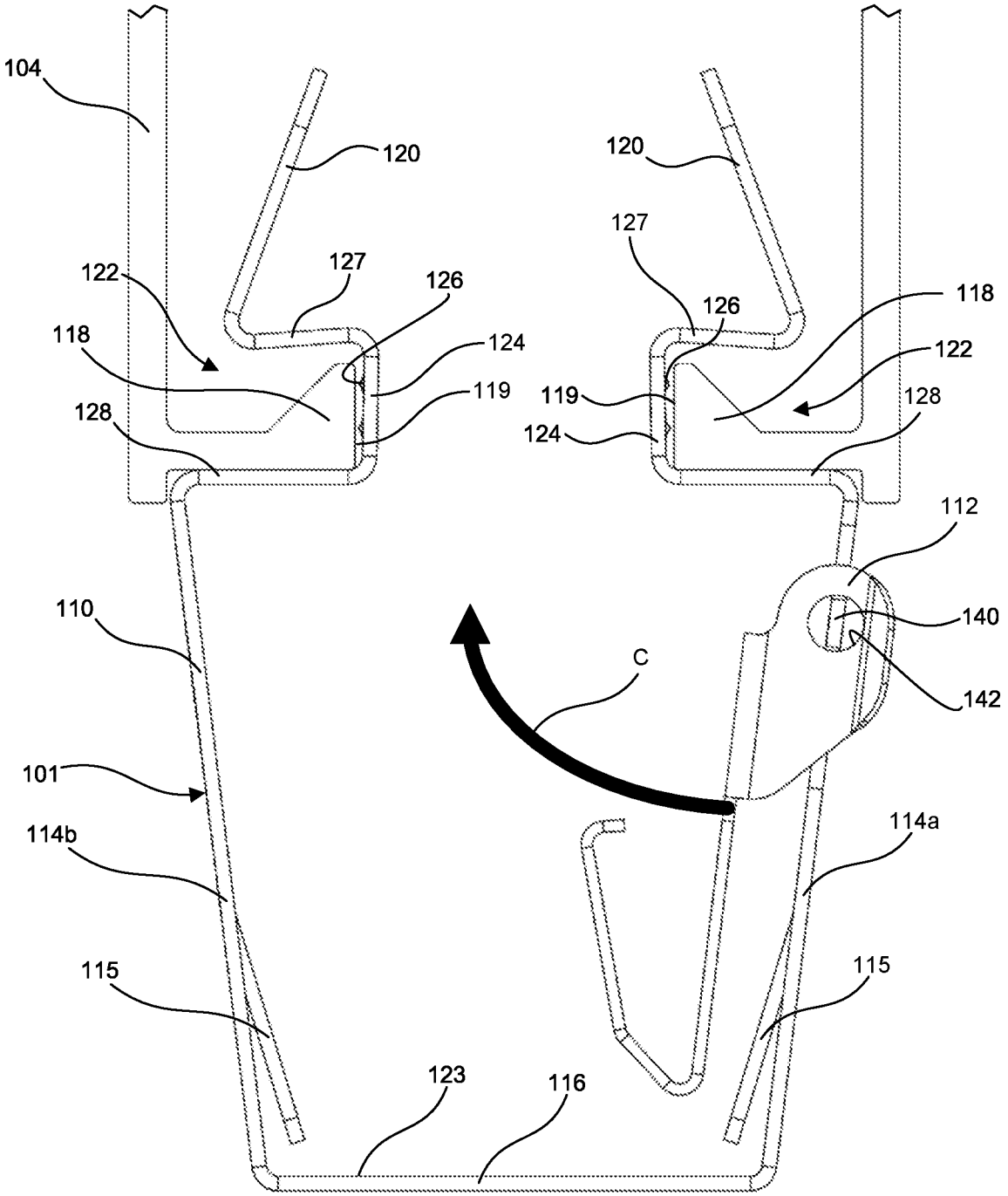
FIG. 3B is a front view of an intermediate assembly step of the portion of the building material attachment system.
Figure 3C:
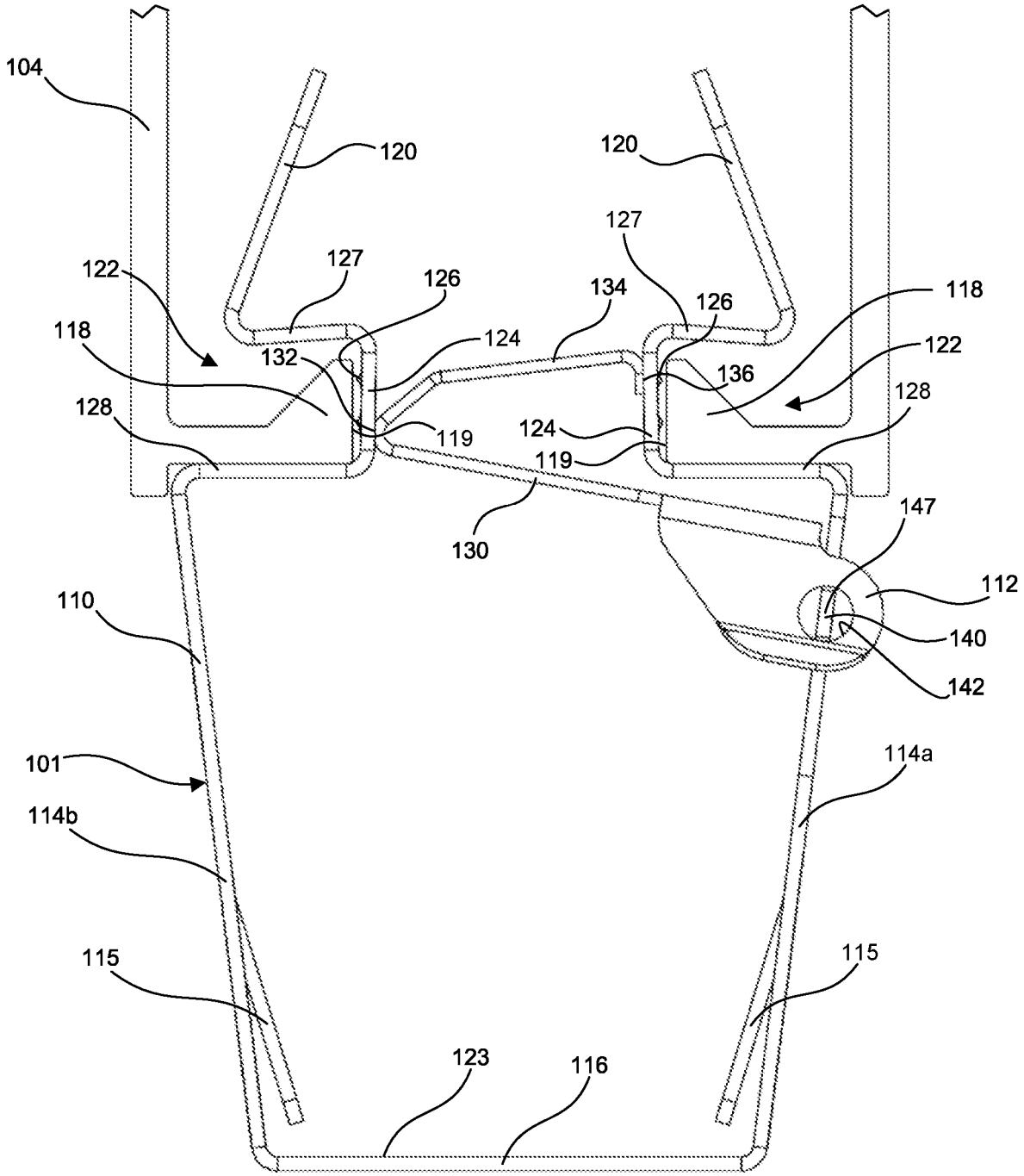
FIG. 3C is an assembled front view of the portion of the building material attachment system, each configured in accordance with some embodiments of the present technology.

FIG. 3A is a partially exploded front view of a portion of the support beam 104 and the clip assembly 101 having the clip 110 and the locking device 112; FIG. 3B is a front view of an intermediate assembly step of the clip assembly 101 and the support beam 104; and FIG. 3C is an assembled side view of the clip assembly 101 and the support beam 104, in which each component is configured in accordance with some embodiments of the present technology. Referring first to FIG. 3A, the clip assembly 101 is shown separated from the support beam 104 and the locking device 112 is rotated out of locking engagement with the clip 110. In this embodiment, the support beam 104 includes a channel area 117 having opposing flanges 118 configured to operably engage corresponding pockets 122 of the clip 110 when the clip assembly 101 is assembled to or otherwise installed on the support beam 104.

During assembly, the clip assembly 101 is moved toward the channel area 117 of the support beam 104 in the direction of arrow A. Opposing inner surfaces 119 of the flanges 118 define an opening that is narrower than the width between the distal end portions 120 of the walls 114 of the clip 110, such that as the distal end portions 120 come into contact with the flanges 118, the distal end portions 120 are temporarily and resiliently deflected inwardly toward each other in the direction of arrows B to insert the end portion of the clip 110 into the channel area 117 to a position where the opposing flanges 118 are operably received in the pockets 122, as shown in FIG. 3B. To facilitate the insertion of the clip assembly 101 into the channel area 117, the distal end portions 120 can be positioned at a tapering inward angle such that once the distal end portions 120 initially contact the inner surfaces 119 of the opposing flanges 118, further insertion of the clip 110 in the direction of arrow A resiliently deflects the distal end portions 120 further inwardly.

Referring now to FIG. 3B, when the clip assembly 101 reaches a position of insertion into the channel area 117 where the opposing flanges 118 are aligned with the pockets 122, the resiliency of the walls 114 cause the distal end portions 120 of the clip 110 to return outwardly in a direction opposite the arrows B (FIG. 3A) such that the opposing flanges 118 are seated within the pockets 122 as shown in FIG. 3B. In this position, the opposing flanges 118 may contact the first pocket walls 128, the second pocket walls 127, and/or the inner pocket walls 124. As noted above, the inner pocket walls 124 can include one or more of the burst holes 125 having the sharp protrusions 126 configured to engage the inner surfaces 119 of the flanges 118 to prevent the clip assembly 101 from sliding longitudinally along the channel area 117 of the support beam 104. In some embodiments, the clip 110 can be configured so that, in the uninstalled state (the "relaxed" or "free" state) the distance between the inner pocket walls 124 is greater than the distance between the inner surfaces 119 of the flanges 118 such that when the clip 110 is assembled to the support beam 104, the walls 114 of the clip 110 provide an outwardly biasing force to the distal end portions 120 and press the sharp protrusions 126 against the inner surfaces 119 of the opposing flanges 118.

After the clip 110 has sprung outward such that the opposing flanges 118 are seated within the pockets 122 as shown in FIG. 3B, the locking device 112 can be rotated in the direction of arrow C toward the opening between the inner pocket walls 124 to prevent the clip assembly 101 from inadvertently disengaging from the support beam 104. The rotation of the locking device 112 can be facilitated by the pivot tab 140 of the clip 110 operably engaged with the aperture 142 of the locking device 112. In other embodiments, the locking device 112 can rotate with respect to the clip 110 using other suitable means, e.g., a pin, a hinge, a bearing, a fastener, etc.

Referring now to FIG. 3C, the locking device 112 is shown in a locked position. In some embodiments the locking device 112 includes a first web portion 130 extending between the apertures 142 and a first locking surface 132, and a second web portion 134 extending between the first locking surface 132 and a second locking surface 136. In the locked position, the first locking surface 132 abuts the inner pocket wall 124 opposite the tabs 140 and the second locking surface 136 abuts the other of the inner pocket walls 124. The first web portion 130 can be positioned offset from the pivot axis 147 of the aperture 142 such that a force exerted in a direction along the lower web portion 130 by the contact of the inner pocket surface 124 against the first locking surface 132 imparts a torque on the locking device 112 about the pivot axis 147 of the aperture 142 biasing the locking device 112 toward the locked position (e.g., in a clockwise direction about the pivot axis 147 of the aperture 142). The second web portion 134 can be configured to further separate the distal end portions 120 and engage the sharp protrusions 126 against the surfaces 119 of the opposing flanges 118 to prevent or at least inhibit the clip 110 from sliding laterally along the channel area 117 of the support beam 104. Although FIGS. 3A-3C show installation of the clip assembly 101 to the support beam 104, similar steps can be used to install a clip assembly 101 to any building component having a suitable channel (e.g., the second clip 110*b* to the baffle 106, etc.).

Figure 4A:
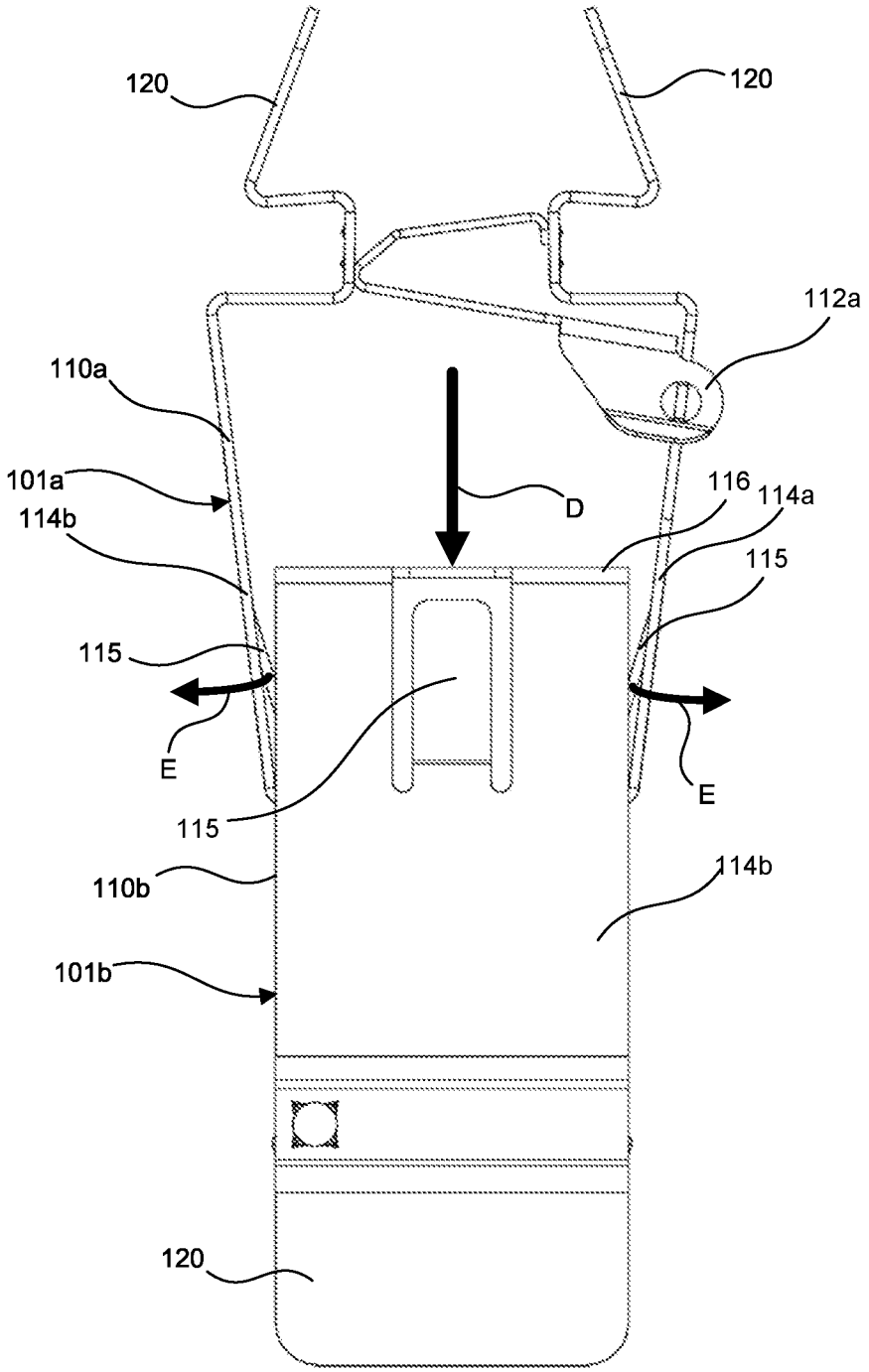
FIG. 4A is a partially exploded front view of the building material attachment system of FIGS. 1A and 1B, with building material attachment clip assemblies of FIG. 2 in a tandem configuration.
Figure 4B:
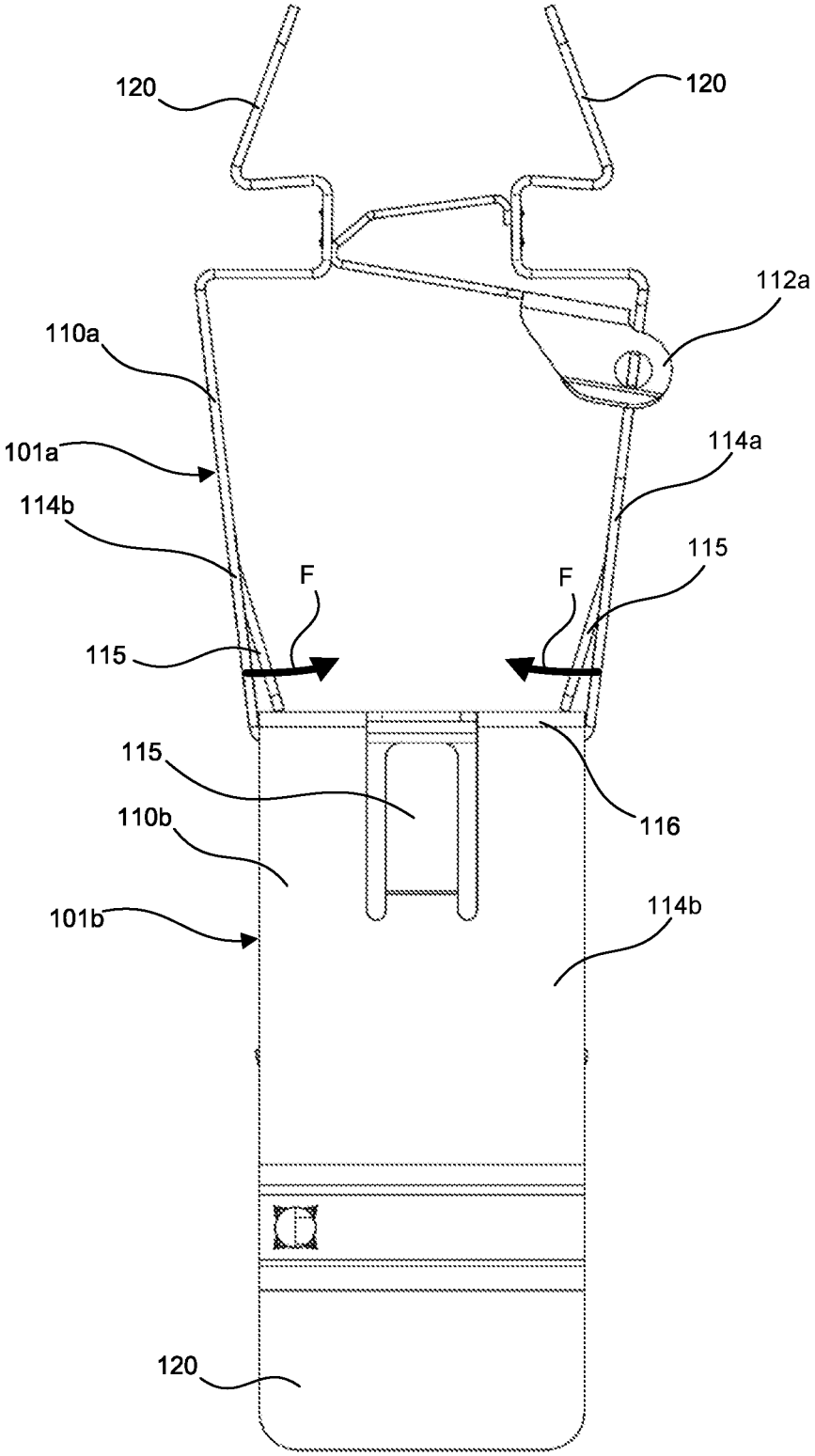
FIGS. 4B and 4C are front and perspective views, respectively, illustrating the assembled building material attachment system of FIG. 4A, each in accordance with some embodiments of the present technology.
Figure 4C:
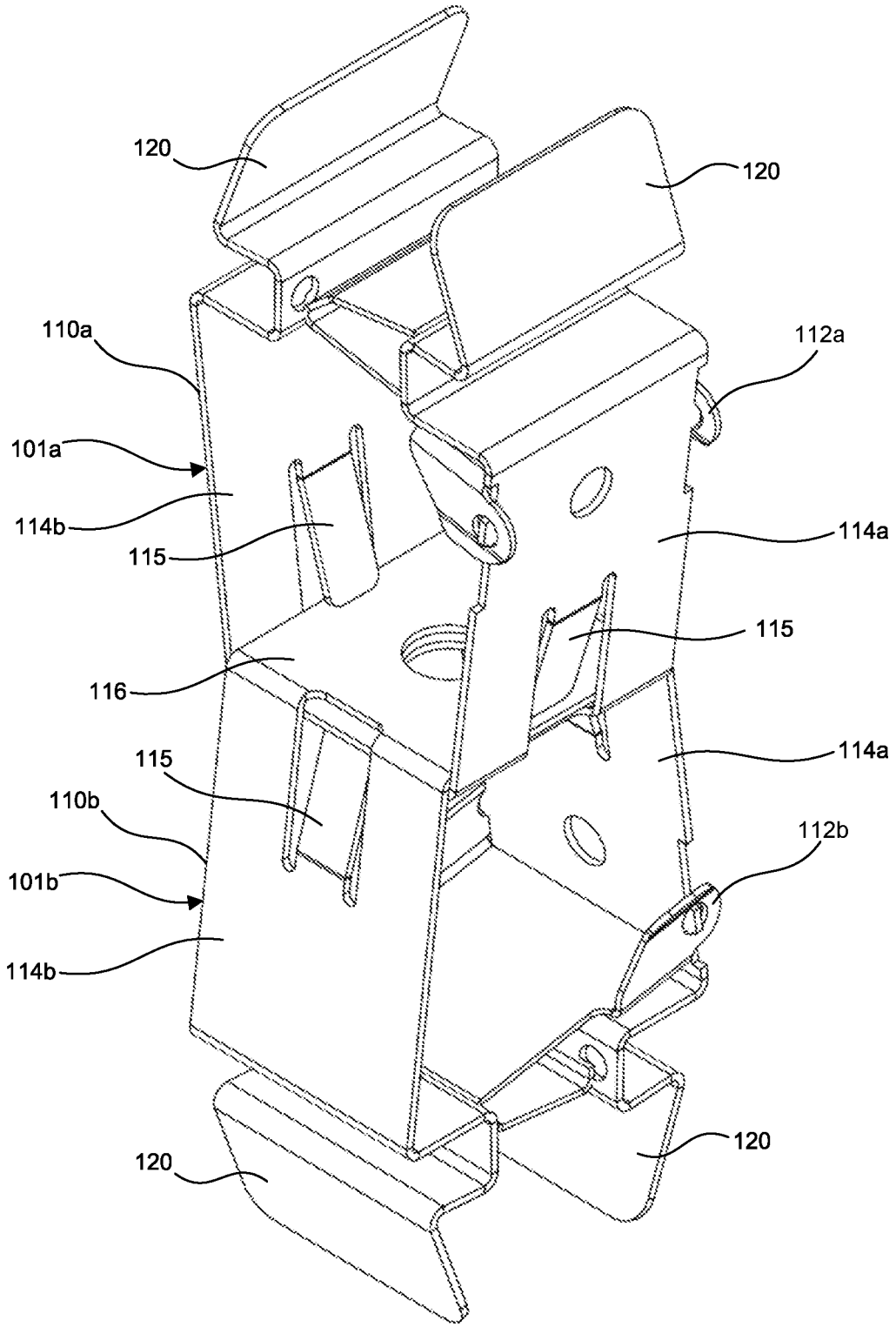

FIG. 4A is a partially exploded front view of a tandem configuration of first and second clip assemblies 101*a* and 101*b* (e.g., arranged in a mirrored orientation and rotated 90° from each other), such as those shown in FIGS. 1A and 1B, with the first clip assembly 101*a* having the first clip 110*a* and the first locking device 112*a*, and with the second clip assembly 101*b* having the second clip 110*b* and the second locking device 112*b*; and FIGS. 4B and 4C are front and perspective views, respectively, illustrating the tandem assembly 101 of FIG. 4A in accordance with some embodiments of the present technology. Referring first to FIG. 4A, the bases 116 of the first and second clips 110*a* and 110*b* are spaced apart and facing each other with the first and second clips 110*a* and 110*b* in the illustrated orientation for assembly (the first or second locking device 112*a* or 112*b* can rotate to an unlocked position (e.g., the position shown in FIG. 3A) to assemble the first and second clips 110*a* and 110*b* in the configuration of FIG. 4A). As the bases 116 of the first and second clips 110*a* and 110*b* are manually moved together in the direction of arrow D, the opposite edges of the base 116 of the second clip 110*b* deflects the locking tabs 115 of the first clip 110*a* outwardly in the direction of arrows E. Concurrently, the opposite edges of the base 116 of the first clip 110*b* deflect the locking tabs 115 of the second clip 110*a* outwardly.

Referring now to FIG. 4B, as the bases 116 of the first and second clips 110*a* and 110*b* continue moving toward each other, the bases 116 reach a position where the locking tabs 115 of the first clip 110*a* no longer engage the base 116 of the second clip 110*b*, and the locking tabs 115 of the second clip 110*b* no longer engage the base 116 of the first clip 110*a*. As a result, the respective locking tabs 115 deflect inwardly in the direction of arrows F. As shown in FIGS. 4B and 4C, in this position the locking tabs 115 of the first clip 110*a* are operably engaged with the base 116 of the second clip 110*b*, and the locking tabs 115 of the second clip 110*b* are operably engaged with the base 116 of the first clip 110*a*, effectively locking or otherwise attaching the first and second clips 110*a* and 110*b* together. In other embodiments, the first and second clips 110*a* and 110*b* can be coupled together using any suitable coupling feature or mechanism, e.g., a fastener through the direct mount apertures 140, a bracket, a clip, self-tapping screws, etc.

FIG. 5 is a front view illustrating a building material attachment system 200 ("system 200") having an arrangement of the clip assemblies 101 for attaching a plurality of building material panels 260*a* and 260*b* to a surface of a building (e.g., a side wall, ceiling wall, etc.; not shown in FIG. 5), in accordance with some embodiments of the present technology. In some embodiments, the system 200 includes the first and second clips 110*a* and 110*b* in a side-by-side configuration. The system 200 further includes a dual-channel support beam 204 configured to operably engage the first and second clips 110*a* and 110*b* in a side-by-side configuration. The first clip 110*a* is positioned to attach a first panel 260*a* to the building surface (e.g., by a corner or edge of the first panel 260*a*) and the second clip 110*b* is positioned to attach a second panel 260*b* to the building surface (e.g., by a corner or edge of the second panel 260*b*). The first and second panels 260*a* and 260*b* can be attached to the first and second clips 110*a* and 110*b* with any suitable fastener, e.g., by a bolt 250 with a threaded shank 252, a washer 254, and a nut 256 assembled through the apertures 141 of each of the first and second clips 110*a* and 110*b*. In some embodiments, the washer 254 and/or the nut 256 can be integrated into or otherwise fixedly or removably attached to the first and second clips 110*a* and 110*b*, e.g., by a punch and thread feature where the material is formed into an integrated threaded feature as an operation of forming the aperture 141, a nut welded to the inner surface 123 of the base 116, an adhesive nut bonded to the inner surface 123 of the base 116, a nut clipped on the base 116, etc. In other embodiments, the panels 260*a* and 260*b* can be attached to the first and second clips 110*a* and 110*b* by a self-tapping screw, a clip, adhesive, etc.

The number and spacing of clips 110 in a building material attachment system (e.g., the systems 100 and 200 described herein) is typically determined by the dead load of the material (baffles, panels, etc.), the potential seismic loading, as well as the structural capacity of the individual building material attachment devices. In general, if the structural capacity of the individual attachment devices is relatively low, then the attachment devices will have to be placed next to each other in relatively close proximity to carry the applied loads. This can increase the number of attachment devices required for any particular application, which increases cost and installation time. In one aspect of some embodiments of the present technology, the building material attachment clips 110 described herein can be positioned at relatively high spacings because of their relatively high structural load capacity, thereby reducing the overall number of attachment devices required for a particular application.

References throughout the foregoing description to features, advantages, benefits, or similar language do not imply that all of the features and advantages that may be realized with the present technology should be or are in any single embodiment of the present technology. Rather, language referring to the features and advantages is understood to mean that a specific feature, advantage, or characteristic described in connection with an embodiment is included in at least one embodiment of the present technology. Thus, discussion of the features and advantages, and similar language, throughout this specification may, but do not necessarily, refer to the same embodiment. Furthermore, the described features, advantages, and characteristics of the present technology may be combined in any suitable manner in one or more embodiments. One skilled in the relevant art will recognize that the present technology can be practiced without one or more of the specific features or advantages of a particular embodiment. In other instances, additional features and advantages may be recognized in certain embodiments that may not be present in all embodiments of the present technology.

Any patents and applications and other references noted above, including any that may be listed in accompanying filing papers, are incorporated herein by reference in the entirety, except for any subject matter disclaimers or disavowals, and except to the extent that the incorporated material is inconsistent with the express disclosure herein, in which case the language in this disclosure controls. Aspects of the present technology can be modified, if necessary, to employ the systems, functions, and concepts of the various references described above to provide yet further implementations of the present technology.

The above Detailed Description of examples and embodiments of the present technology is not intended to be exhaustive or to limit the present technology to the precise form disclosed above. While specific examples for the present technology are described above for illustrative purposes, various equivalent modifications are possible within the scope of the present technology, as those skilled in the relevant art will recognize. The teachings of the present technology provided herein can be applied to other systems, not necessarily the system described above. The elements and acts of the various examples described above can be combined to provide further implementations of the present technology. Some alternative implementations of the present technology may include not only additional elements to those implementations noted above, but also may include fewer elements. Further any specific numbers noted herein are only examples: alternative implementations may employ differing values or ranges.

From the foregoing, it will be appreciated that specific embodiments of the present technology have been described herein for purposes of illustration, but that various modifications may be made without deviating from the spirit and scope of the various embodiments of the present technology. Further, while various advantages associated with certain embodiments of the present technology have been described above in the context of those embodiments, other embodiments may also exhibit such advantages, and not all embodiments need necessarily exhibit such advantages to fall within the scope of the present technology. Accordingly, the present technology is not limited, except as by the appended claims.

Although certain aspects of the present technology are presented below in certain claim forms, the applicant contemplates the various aspects of the present technology in any number of claim forms. Accordingly, the applicant reserves the right to pursue additional claims after filing this application to pursue such additional claim forms, in either this application or in a continuing application.

We claim:

1. An assembly for attaching a piece of material to a building structure, the assembly comprising:

a clip, having— a base;

a first wall projecting away from the base, the first wall including a first laterally outward facing pocket configured to operably receive a first flange portion of a support member, the first wall further including a first distal end portion extending from the first pocket and away from the base; and a second wall projecting away from the base opposite the first wall, the second wall including a second laterally outward facing pocket configured to operably receive a second flange portion of the support member opposite the first flange portion, the second wall further including a second distal end portion extending from the second pocket and away from the base, wherein the first and second distal end portions are angled inwardly toward each other, and wherein the first and second distal end portions are configured to contract the first and second flange portions, respectively, and deflect inwardly toward each other as the clip is inserted into an opening between the first and second flange portions; and a locking device pivotably coupled to the clip and rotatable between an unlocked position and a locked position, wherein, in the locked position, the locking device contacts portions of the first and second walls to bias the first and second walls away from each other.

2. The assembly of claim 1, wherein the base includes one or more apertures configured to receive a fastener for attaching the piece of material to the clip.

3. The assembly of claim 1, wherein, in the locked position, a portion of the locking device positioned between the first and second pockets includes a first locking surface portion abutting an inner pocket wall of the first pocket and a second locking surface portion abutting an inner pocket wall of the second pocket.

4. The assembly of claim 1, wherein the first wall includes an aperture configured to couple a tie, a cable, and/or a brace to the clip.

5. The assembly of claim 1 wherein the locking device includes an arm rotatable between the unlocked position and the locked position, and wherein the arm is generally parallel to the first wall when in the unlocked position and extends between the first wall and the second wall when in the locked position.

6. An assembly for attaching a piece of material to a building structure, the assembly comprising:

a clip, having— a base;

a first wall projecting away from the base, the first wall including a first laterally outward facing pocket configured to operably receive a first flange portion of a support member; and a second wall projecting away from the base opposite the first wall, the second wall including a second laterally outward facing pocket configured to operably receive a second flange portion of the support member opposite the first flange portion, wherein at least the first pocket has an inner pocket wall with a protrusion protruding outwardly into the first pocket and configured to engage an inner surface of the first flange portion to prevent translation of the clip relative to the support member; and a locking device pivotably coupled to the clip and rotatable between an unlocked position and a locked position, wherein, in the locked position, the locking device contacts portions of the first and second walls to bias the first and second walls away from each other.

7. The assembly of claim 6, wherein, in the locked position, a portion of the locking device positioned between the first and second pockets is configured to apply an outwardly directed force driving the first and second walls against the first and second flange portions, respectively.

8. The assembly of claim 6, wherein the base includes one or more apertures configured to receive a fastener for attaching the piece of material to the clip.

9. The assembly of claim 6, wherein the first wall further comprises a first distal end portion extending from the first pocket and away from the base, wherein the second wall further comprises a second distal end portion extending from the second pocket and away from the base, and wherein the first and second distal end portions are configured to deflect inwardly toward each other as the clip is inserted into an opening between the first and second flange portions.

10. An assembly for attaching a piece of material to a building structure, the assemble comprising:

a clip, having— a base;

a first wall projecting away from the base, the first wall including a first laterally outward facing pocket configured to operably receive a first flange portion or a support member; and a second wall projecting away from the base opposite the first wall, the second wall including a second laterally outward facing pocket configured to operably receive a second flange portion of the support member opposite the first flange portion; and a locking device pivotably coupled to the clip and rotatable between an unlocked position and a locked position, wherein, in the locked position, the locking device contacts portions of the first and second walls to bias the first and second walls away from each other, wherein the locking device is configured to rotate about a pivot axis, wherein the locking device includes a first web portion extending between the pivot axis and a first locking surface portion and positioned offset from the pivot axis, and wherein, in the locked position, a force exerted along the first web portion by interaction of the first locking surface portion with an inner pocket wall of the second pocket imparts a torque on the locking device biasing the locking device toward the locked position.

11. The assembly of claim 10, wherein the base includes one or more apertures configured to receive a fastener for attaching the piece of material to the clip.

12. The assembly of claim 10, wherein, in the locked position, the first locking surface portion abuts the inner pocket wall of the second pocket and a second locking surface portion of the locking device abuts an inner pocket wall of the first pocket.

13. An assembly for attaching a piece of material to a building structure, the assembly comprising:

a clip, having— a base;

a first wall projecting away from the base, the first wall including a first laterally outward facing pocket having first, second, and third flat walls substantially forming a U-shape configured to receive a first squared off flange portion of a support member; and a second wall projecting away from the base opposite the first wall, the second wall including a second laterally outward facing pocket having first, second, and third flat walls substantially forming a U-shaped configured to receive a second squared off flange portion of the support member opposite the first squared off flange portion; and a locking device pivotable coupled to the clip and rotatable between an unlocked position and a locked position, wherein, in the locked position, the locking device contacts portions of the first and second walls to bias the first and second walls away from each other.

14. The assembly of claim 13, wherein the first wall further comprises a first distal end portion extending from the first pocket and away from the base, wherein the second wall further comprises a second distal end portion extending from the second pocket and away from the base, and wherein the first and second distal end portions are angled inwardly toward each other.

15. The assembly of claim 14, wherein the first and second distal end portions are configured to contact the first and second flange portions, respectively, and deflect inwardly toward each other as the clip is inserted into an opening between the first and second flange portions.

16. The assembly of claim 13, wherein the base includes one or more apertures configured to receive a fastener for attaching the piece of material to the clip.

17. The assembly of claim 13, wherein, in the locked position, a first locking surface portion of the locking device abuts an inner pocket wall of the second pocket and a second locking surface portion of the locking device abuts an inner pocket wall of the first pocket.

18. An attachment system for attaching a piece of material to a building, the attachment system comprising:

a support member having a channel at least partially defined by opposing first and second flange portions;

a clip, having— a base;

a first wall projecting away from the base, the first wall including a first laterally outward facing pocket configured to operably receive the first flange portion, the first wall further including a first distal end portion extending from the first pocket and away from the base; and a second wall projecting away from the base opposite the first wall, the second wall including a second laterally outward facing pocket configured to operably receive the second flange portion, the second wall further including a second distal end portion extending from the second pocket and away from the base, wherein the first and second distal end portions are angled inwardly toward each other, and wherein the first and second distal end portions are configured to contact the first and second flange portions, respectively, and deflect inwardly toward each other as the clip is inserted into an opening between the first and second flange portions; and a locking device having an arm rotatable between an unlocked position in which the arm is generally parallel to the first wall and a locked position in which the arm extends between the first wall and the second wall.

19. An attachment system for attaching a piece of material to a building, the attachment system comprising:

a support member having a channel at least partially defined by opposing first and second flange portions;

a clip, having— a base, a first wall projecting away from the base, the first wall including a first laterally outward facing pocket configured to operably receive the first flange portion; and a second wall projecting away from the base opposite the first wall, the second wall including a second laterally outward facing pocket configured to operably receive the second flange portion, and a locking device having an arm rotatable between an unlocked position in which the arm is generally parallel to the first wall and a locked position in which the arm extends between the first wall and the second wall, wherein the locking device is configured to rotate about a pivot axis, wherein the arm includes a first locking surface portion and a first web portion extending between the pivot axis and the first locking surface portion and positioned offset from the pivot axis, and wherein, in the locked position, a force exerted along the first web portion by interaction of the first locking surface portion with the second wall imparts a torque on the locking device biasing the locking device toward the locked position.

20. The attachment system of claim 19, wherein the base includes one or more apertures configured to receive a fastener for attaching the piece of material to the clip.

21. The attachment system of claim 19, wherein the first and second flange portions are first and second squared off flange portions, respectively, wherein the first laterally outward facing pocket includes first, second, and third flat walls substantially forming a U-shape configured to receive the first squared off flange portion, and wherein the second laterally outward facing pocket includes first, second, and third flat walls substantially forming a U-shape configured to receive the second squared off flange portion.

22. An attachment system for attaching a piece of material to a building, the attachment system comprising:

a support member having a channel at least partially defined by opposing first and second flange portions, a first clip having— a base;

a first wall projecting away from the base, the first wall including a first laterally outward facing pocket configured to operably receive the first flange portion;

a second wall projecting away from the base opposite the first wall, the second wall including a second laterally outward facing pocket configured to operably receive the second flange portion; and a locking tab positioned between the base and the first pocket;

a locking device having an arm rotatable between an unlocked position in which the arm is generally parallel to the first wall and a locked position in which the arm extends between the first wall and the second wall; and a second clip having a base configured to operably engage the locking tab when the first and second clips are in a tandem configuration.

23. The attachment system of claim 22, wherein the first wall further comprises a first distal end portion extending from the first pocket and away from the base, wherein the second wall further comprises a second distal end portion extending from the second pocket and away from the base, and wherein the first and second distal end portions are angled inwardly toward each other.

24. The attachment system of claim 23, wherein the first and second distal end portions are configured to contact the first and second flange portions, respectively, and deflect inwardly toward each other as the clip is inserted into an opening between the first and second flange portions.

25. The attachment system of claim 22, wherein:

the first clip is received in the channel and operably coupled to the support member, the second clip is in the tandem configuration with the first clip, and the second clip is operably coupled to the piece of material.

26. An attachment system for attaching a piece of material to a building, the attachment system comprising:

a support member having— a first channel at least partially defined by opposing first and second flange portions; and a second channel adjacent to the first channel;

a first clip configured to be received in and operably engaged with the first channel, the first clip having— a base, the base having an aperture configured to receive a fastener therethrough attaching a first piece of building material to the first clip;

a first wall projecting away from the base, the first wall including a first laterally outward facing pocket configured to operably receive the first flange portion; and a second wall projecting away from the base opposite the first wall, the second wall including a second laterally outward facing pocket configured to operably receive the second flange portion;

a locking device having an arm rotatable between an unlocked position in which the arm is generally parallel to the first wall and a locked position in which the arm extends between the first wall and the second wall; and a second clip having a base and third and fourth laterally outward facing pockets, the second clip configured to be received in and operably engaged with the second channel, the base of the second clip having an aperture configured to receive a fastener therethrough attaching a second piece of building material to the second clip.

27. The system of claim 26, wherein the first wall further comprises a first distal end portion extending from the first pocket and away from the base, wherein the second wall further comprises a second distal end portion extending from the second pocket and away from the base, and wherein the first and second distal end portions are configured to deflect inwardly toward each other as the clip is engaged with the first channel.

28. An assembly for attaching a piece of material to a building structure, the assembly comprising:

a clip, having— a base;

a first wall projecting away from the base, the first wall including a first laterally outward facing pocket configured to operably receive a first support portion;

a second wall projecting away from the base and spaced apart from the first wall, the second wall including a second laterally outward facing pocket configured to operably receive a second support portion; and at least two tabs projecting outwardly from the first wall; and a locking device having at least two apertures therein, wherein each of the apertures receives a corresponding one of the tabs to pivotably couple the locking device to the clip, wherein the locking device is rotatable between an unlocked position and a locked position, and wherein the locking device contacts portions of the first and second walls when the locking device is in the locked position.

29. The assembly of claim 28 wherein the locking device includes an arm rotatable between the unlocked position and the locked position, and wherein the arm is generally parallel to the first wall when in the unlocked position and extends between the first wall and the second wall when in the locked position.

30. The assembly of claim 28 wherein the locking device further comprises first and second side flanges, and wherein the first side flange includes a first one of the at least two apertures and the second side flange includes a second one of the at least two apertures.

31. The assembly of claim 28 wherein the first wall and the second wall project away from the base in the same direction.

32. The assembly of claim 28 wherein the first laterally outward facing pocket and the second laterally outward facing pocket face in opposite directions.

* * * * *